US011186468B2

(12) United States Patent
Huang

(10) Patent No.: US 11,186,468 B2
(45) Date of Patent: Nov. 30, 2021

(54) WINCH CAPABLE OF EXTERNALLY CONNECTING MOTOR TO INCREASE DYNAMIC POWER

(71) Applicant: Comeup Industries Inc., Taipei (TW)

(72) Inventor: Shih-Jyi Huang, Taipei (TW)

(73) Assignee: Comeup Industries Inc., Taipei (TW)

( * ) Notice: Subject to any disclaimer, the term of this patent is extended or adjusted under 35 U.S.C. 154(b) by 64 days.

(21) Appl. No.: 16/842,965

(22) Filed: Apr. 8, 2020

(65) Prior Publication Data

US 2021/0316972 A1 Oct. 14, 2021

(51) Int. Cl.
*B66D 1/12* (2006.01)
*B66D 1/28* (2006.01)

(52) U.S. Cl.
CPC ..... *B66D 1/12* (2013.01); *B66D 1/28* (2013.01)

(58) Field of Classification Search
CPC ... B66D 1/02; B66D 1/12; B66D 1/28; B66D 1/14; B66D 1/26; B66D 1/22; B66D 1/54
See application file for complete search history.

(56) References Cited

U.S. PATENT DOCUMENTS 2,345,662 A * 4/1944 Fox ..... B66D 1/26 254/340
3,698,690 A * 10/1972 Beaver ..... B66D 1/14 254/340
3,738,614 A * 6/1973 Peterson ..... B66D 5/00 254/358
4,098,139 A * 7/1978 Sankey ..... B66D 1/14 74/410
4,426,064 A * 1/1984 Healy ..... B66D 1/14 254/342
5,344,230 A * 9/1994 Kowalczyk ..... B29C 48/40 366/100
6,182,945 B1 * 2/2001 Dyer ..... E21B 19/008 254/340
6,966,544 B2 * 11/2005 McCormick ..... B66B 1/32 254/342
7,270,312 B1 * 9/2007 Phipps ..... B66D 1/22 254/278
7,461,832 B2 * 12/2008 Zhang ..... B66D 1/14 212/274
8,272,151 B2 * 9/2012 Ries ..... E02F 9/2016 37/395
8,523,147 B2 * 9/2013 Zheng ..... B66D 1/12 254/345
8,746,101 B2 * 6/2014 Hausladen ..... F16D 7/08 74/421 A (Continued)

*Primary Examiner* — Michael E Gallion
(74) *Attorney, Agent, or Firm* — Karin L. Williams; Alan D. Kamrath; Mayer & Williams PC

(57) ABSTRACT

A winch capable of externally connecting motor is to selectively assemble and increase an externally connected motor (a third motor) on a winch driven by a set of motors so that a driving device disposed inside a driving device box of the winch is driven by dynamic power supplied from three motor at the same time to provide greater pulling force and faster pulling rate for a rope wheel of the winch, thereby providing wider scope of application. Moreover, the externally connected motor (the third motor) can be disassembled when there is no need such that dynamic power is provided by two motors so as to save power and energy resource.

5 Claims, 10 Drawing Sheets

(56) References Cited

U.S. PATENT DOCUMENTS

| | | | | |
|---|---|---|---|---|
| 8,820,719 | B2 * | 9/2014 | Ferrari | B66D 1/12 254/340 |
| 9,051,160 | B2 * | 6/2015 | Zheng | B66D 1/14 |
| 10,138,098 | B2 * | 11/2018 | Sorensen | B66D 1/26 |
| 10,208,817 | B2 * | 2/2019 | Netecke | B66D 5/14 |
| 10,246,311 | B2 * | 4/2019 | Bulling | B66D 1/22 |
| 10,767,731 | B2 * | 9/2020 | Simula | F16H 1/22 |
| 2003/0160456 | A1 * | 8/2003 | Wobben | F03D 80/70 290/44 |
| 2015/0083985 | A1 * | 3/2015 | Lervik | B66D 1/12 254/340 |
| 2017/0305729 | A1 * | 10/2017 | Lautwein | B66D 5/06 |
| 2017/0362067 | A1 * | 12/2017 | Hiekata | B66D 1/16 |
| 2018/0022588 | A1 * | 1/2018 | Ho | B66D 1/54 254/362 |
| 2018/0141790 | A1 * | 5/2018 | Paal | B66D 1/12 |

* cited by examiner

WINCH CAPABLE OF EXTERNALLY CONNECTING MOTOR TO INCREASE DYNAMIC POWER

BACKGROUND OF THE INVENTION

Field of the Invention

The present invention relates to a winch, and more particularly to a winch capable of externally connecting a motor so that whole dynamic power can be increased to provide further wider scope of application.

Description of the Related Art

A winch (it is also called "power winch") is designed as a power machine for hanging loads or dragging loads. For example, a hoist for hanging goods (heavy) to vertically lift/descend in high buildings is frequently seen and a winch. A rope winch, which is mounted at fronts of a jeep and an all-terrain vehicle to drag other vehicles, other things or move/escape, is also a kind of winch. The operating principle of the winch uses a power source (a power motor or an electric motor for example) to output positive or revere driving force and then drives a rope wheel to positively rotate or reversely rotate after passing through effect of a deceleration mechanism, thereby delivering or retracting a rope (it can be but not limit to a steel cable or a synthetic rope). A front end of the tope (steel cable or synthetic rope) hooks a load (heavies, other vehicles or other things) through a weight hook so as to move the load.

The structure type of a conventional winch has many types, such as a traditional winch 10, as shown in FIG. 1. A side of the winch 10 has a motor 11. Dynamic power outputted by the motor 11, through driving of an internal shaft, drives a driving device 12 disposed at another side to affect. The inside of the driving device 12 would drive a rope wheel 13 for rotating after experiencing the driving and deceleration effect of several planetary gear sets so that the rope (the steel cable or the synthetic rope not shown in the figure) winding the rope wheel 13 can be released or retracted. A side of the rope wheel 13 is disposed with a clutch device 14 inside the deceleration device 12.

A handle is upwardly stretched from its outside. The handle is manually operated to descend or lift. The driving between the rope wheel 13 and the deceleration device 12 is connected or disconnected through effect of the clutch device 14. The rope wheel 13 is supported by a fixing seat 15 to stably and smoothly drive the power winch 10. The traditional winch 10 can be called a single motor winch.

Since the winch is taken as a power machinery for hanging loads or dragging loads, the single motor winch is restricted by outputted of the single motor, and its taken torque, generated pulling force, and pulling rate will be restricted. Afterward a "dual motor type winch" comes out to increase the torque of the whole winch and pulling force and pulling rate. A dual motor type winch 20, as shown in FIGS. 2, 3, has a driving device box 33. A side of the driving device box 23 is assembled with a set of stationary motors 31, 32. Dynamic power outputted by the set of motors 31, 32 enters in the driving device box 23 through driving and co-drive a driving device (not shown in the figure) disposed inside the driving device box 23 so that a rope (a steel cable or a synthetic rope is not shown in the figure) winding the rope wheel 24 can, through power control, perform motions of releasing or retracting (as the steel cable or the synthetic rope) upon demand. The rope wheel 24 is supported by a support seat 25. The driving device inside the driving device box 23 properly decelerates the dynamic power to drive releasing or retracting the rope (the steel cable or the synthetic rope).

The dual motor type winch 20 combines two motors 21, 22 at an (inside) of the driving device box 23. Appearance of the driving device box 23 is complete. More particularly, its top surface is flattening without exposing any part. Afterward the support seat 25 supports the rope wheel 24 and is co-assembled to the same side of the driving device box 23 and combined below the two motors 21, 22. The winch 20 is tightly assembled and obviously a power machinery. Since the dual motor type winch 20 simultaneously outputs force through the two motors to co-affect the driving device, the rope wheel 24 is supplied with twice torques so that the dual motor type winch 20 is suitable for larger loads or risky environment. In another word, the dual motor type winch 20 can increase the whole power to provide wider scope of application.

SUMMARY OF THE INVENTION

The inventor(s) carries out deeply researches to finally create the innovate design in view of the dual motor winch that can increase whole dynamic power to provide wider scope of application. In another word, a structure device capable of externally connecting a third motor is created on the basis of the dual motor type winch so that the driving device is driven by dynamic power outputted by three motors to provide greater pulling force and faster pulling rate for the rope wheel, thereby expanding the scope of application of the winch.

Therefore, it is a primary objective of the present invention to provide a winch capable of providing greater pulling force and faster pulling rate in order to provide wider scope of application.

To achieve the above-mentioned objective, the present invention relates to a winch capable of externally connecting motors to increase dynamic power, wherein the winch having a set of motors, front ends of output shafts of the set of motors respectively connected with an output gear and stretching into a driving device box disposed at a side to mesh an initial gear of a driving device to further drive a rope wheel, disposed below the set of motors, for rotating so that a rope winding the rope wheel performs motion of releasing or retracting the rope through power control, the rope wheel supported by a support seat; the characterized in that: an externally connected motor further assembled above the set of motors, a front end of the externally connected motor fixedly connected on a top surface of the driving device box through support of a front housing while a rear end is fixedly connected above the support seat through support of a rear support rack, a front end of the output shaft of the externally connected motor disposed with an output gear inside the front housing, an intermediate gear meshed below the output gear, the output gear and the intermediate gear disposed inside the front housing, lower portion of the front housing opened; a top surface of the driving device box opened with an opening hole, a driving gear disposed inside the opening hole, a portion of tooth bodies of the driving gear upwardly penetrating through the opening hole, the intermediate gear inside the front housing meshing the driving gear, the driving gear meshing the initial gear of the driving device.

According to the above-mentioned winch capable of externally connecting motors to increase dynamic power, a front and rear sides at a bottom of the front housing are respectively and outwardly extended to form a joining wall body, and the joining wall body is opened with a joining perforation; a front and rear side wall bodies of the opening hole opened with a joining screw hole correspondingly matching the joining perforation; a top surface of the opening hole pasted with a sealing sheet, the sealing sheet having a piercing hole corresponding to the opening hole and a joining pierced hole corresponding to the joining screw hole; when a front housing at a front end of the externally connected motor fixedly connected to the top surface of the driving device box, the joining wall body of the front housing pasted to the sealing sheet and the top surface of the driving device box so that the joining perforation of the front housing aligns the joining pierced hole of the sealing sheet and the joining screw hole of the driving device box, a screw bolt tightly locked with the joining screw hole of the driving device box after passing through the joining perforation of the front housing, the joining pierced hole of the sealing sheet.

According to the above-mentioned winch capable of externally connecting motors to increase dynamic power, a front and rear end of a spindle of the driving gear are disposed between two side wall bodies of the driving device box through support of a bearing.

According to the above-mentioned winch capable of externally connecting motors to increase dynamic power, an opening hole on the top surface of the driving device box is covered by a decorative cover to shield the opening hole.

According to the above-mentioned winch capable of externally connecting motors to increase dynamic power, the decorative cover is respectively and outwardly extended to form a joining wall body at a front and rear sides at a bottom portion of the main body; and when the decorative cover covers the opening hole, the joining wall body of the decorative cover is pasted to the sealing sheet and a top surface of the driving device box so that a joining through hole of the decorative cover aligns the joining pierced hole of the sealing sheet and the joining screw hole of the driving device box, and a screw bolt is tightly locked with the joining screw hole of the driving device box after passing through the joining through hole of the decorative cover and the joining pierced hole of the sealing sheet.

DETAILED DESCRIPTION OF THE PREFERRED EMBODIMENTS

The technical characteristics, contents, advantages and effects of the present invention will be apparent with the detailed description accompanied with related drawings of preferred embodiments as follows.

Figure 1:
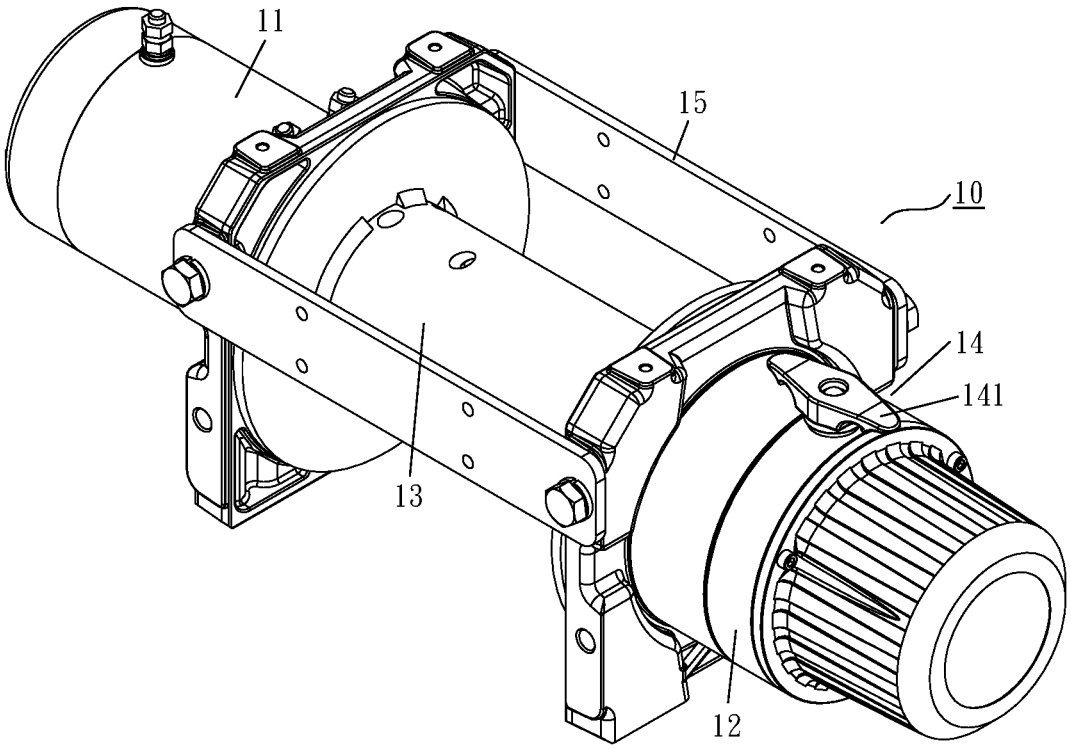
FIG. 1 (PRIOR ART)
FIG. 1 is a three-dimensional drawing of a conventional single motor type winch.
Figure 2:
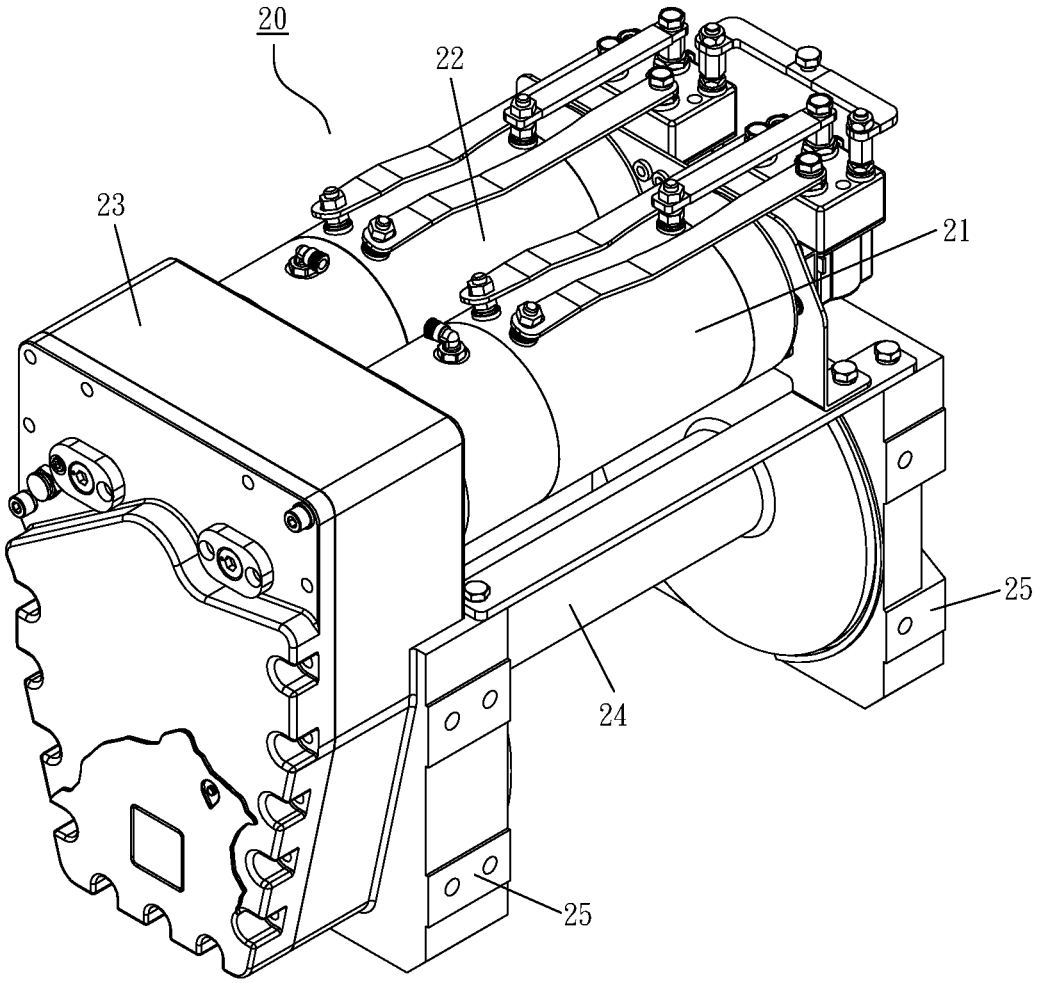
FIG. 2 (PRIOR ART)
FIG. 2 is a three-dimensional drawing of a conventional dual-motor type winch.
Figure 3:
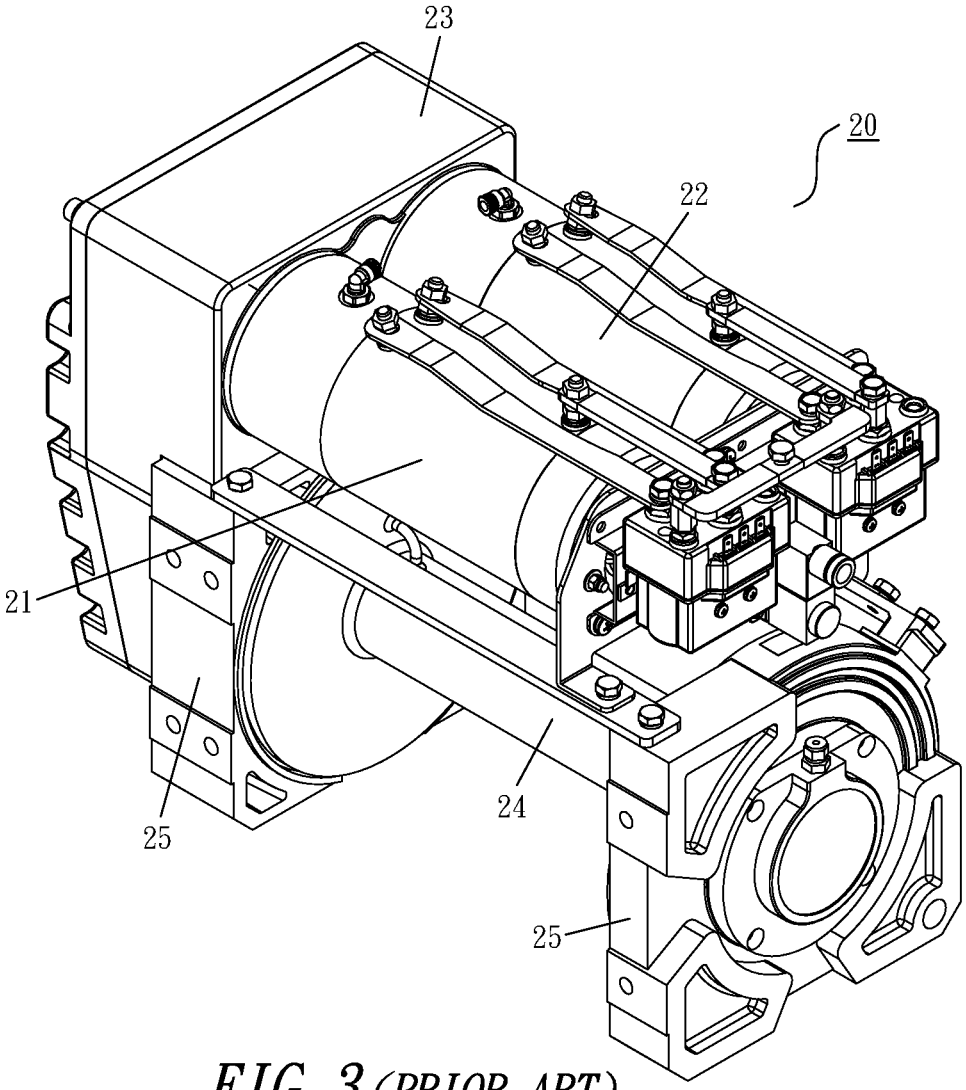
FIG. 3 (PRIOR ART)
FIG. 3 is a three-dimensional drawing of a conventional dual-motor type winch at another angle.
Figure 4:
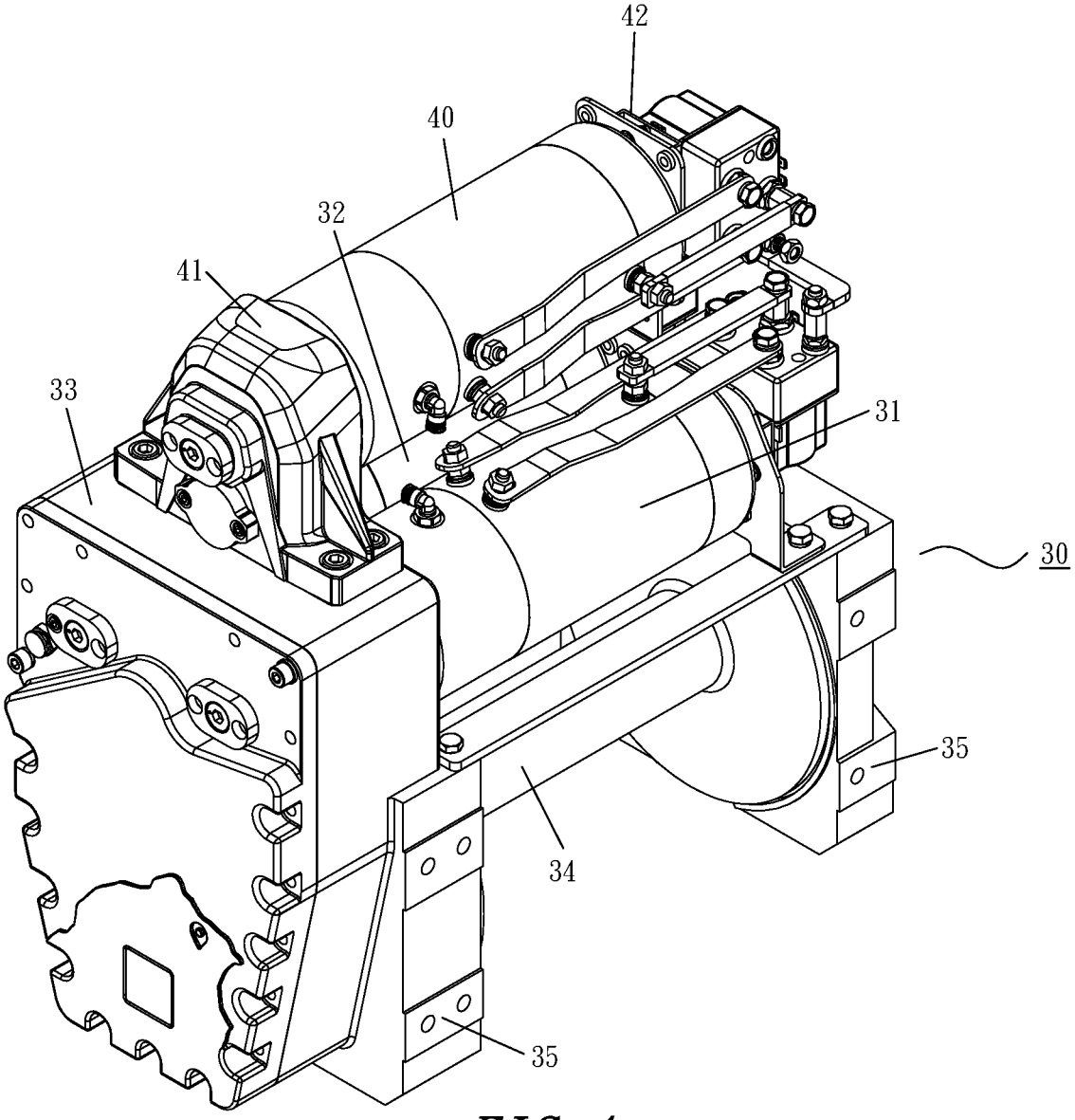
FIG. 4 is a three-dimensional drawing for assembling externally connected motors to form a three-motor type winch according to the embodiment of the invention.
Figure 5:
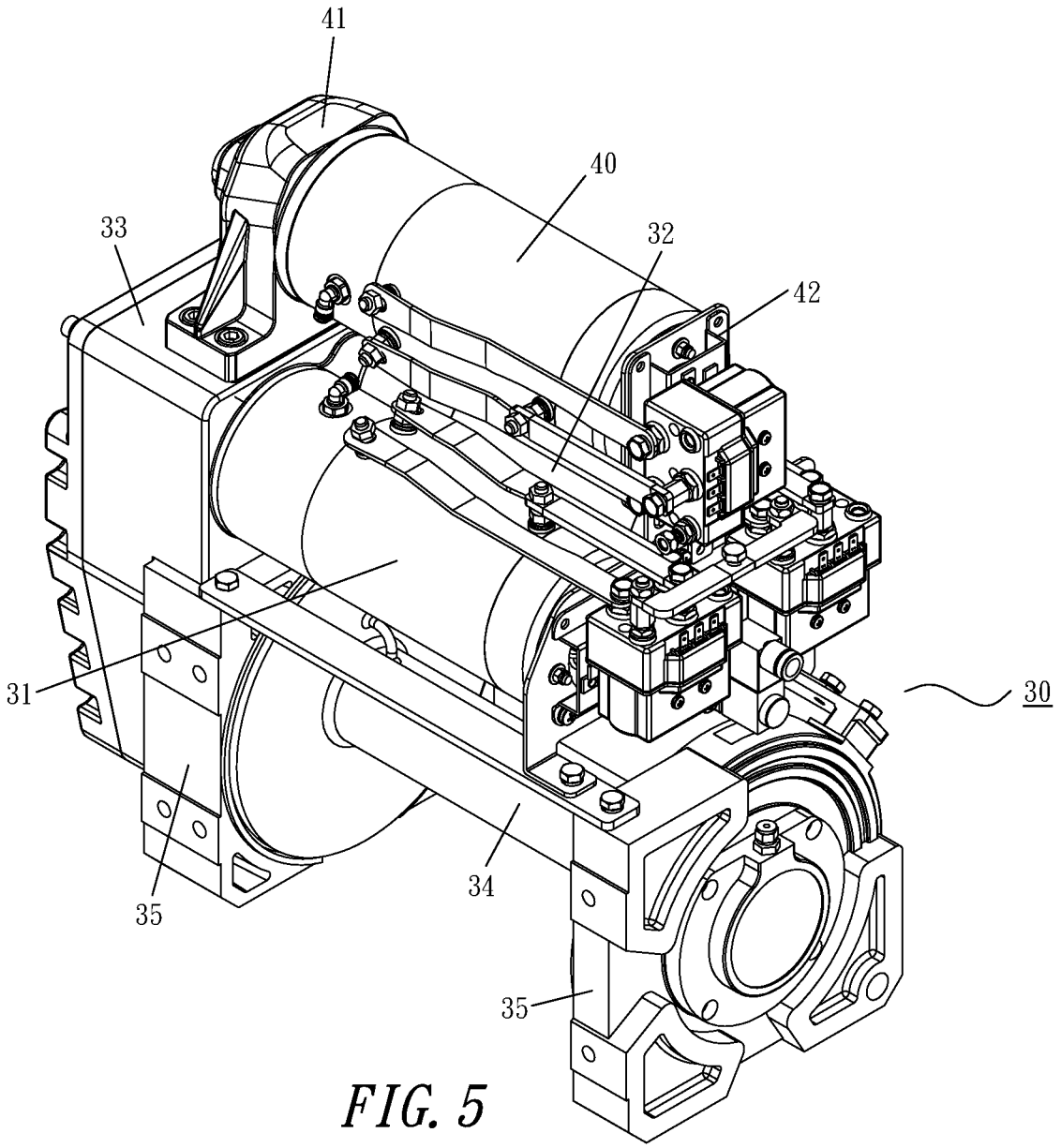
FIG. 5 is a three-dimensional drawing for assembling externally connected motors to form the three-motor type winch at another angle according to the embodiment of the invention.

A winch 30 according to an embodiment of the disclosure compares with appearance composition of a conventional winch 20, as shown in FIGS. 4, 5, the winch 30 has a set of stationary motors 31, 32 at the same time. Power outputted by the set of motors 32 is transmitted into a driving device box 33 disposed at a side through driving and then instantly drives a driving device (not shown in FIGS. 4, 5) disposed inside the driving device box 33, thereby further driving a rope wheel 34, in which its location is disposed below the set of motors 31, 32, for rotating so that a rope (similar to steel cable or synthetic rope and not shown in the figure) wining the rope wheel 34 can be controlled by power, and the rope can perform motion of stretching out or retracting on demand. The rope wheel 34 is supported by a support seat 35. By comparing with the conventional winch 20, the winch 30 is further assembled with an externally connected motor 40 above the set of motors 31, 32. The externally connected motor 40 is a "third motor" capable of being selectively assembled or selectively disassembled. One end of the externally connected motor 40 is fixedly connected to a top surface (as shown in FIG. 4) of the driving device box 33 through support of a front housing 41 while another end (rear end) is fixedly connected above the support seat 35 through support of a rear support rack 42. Therefore, with co-support of the font housing 41 and the rear support rack 42, the externally connected motor 40 steadily stay above the set of motors 31, 32.

Figure 6:
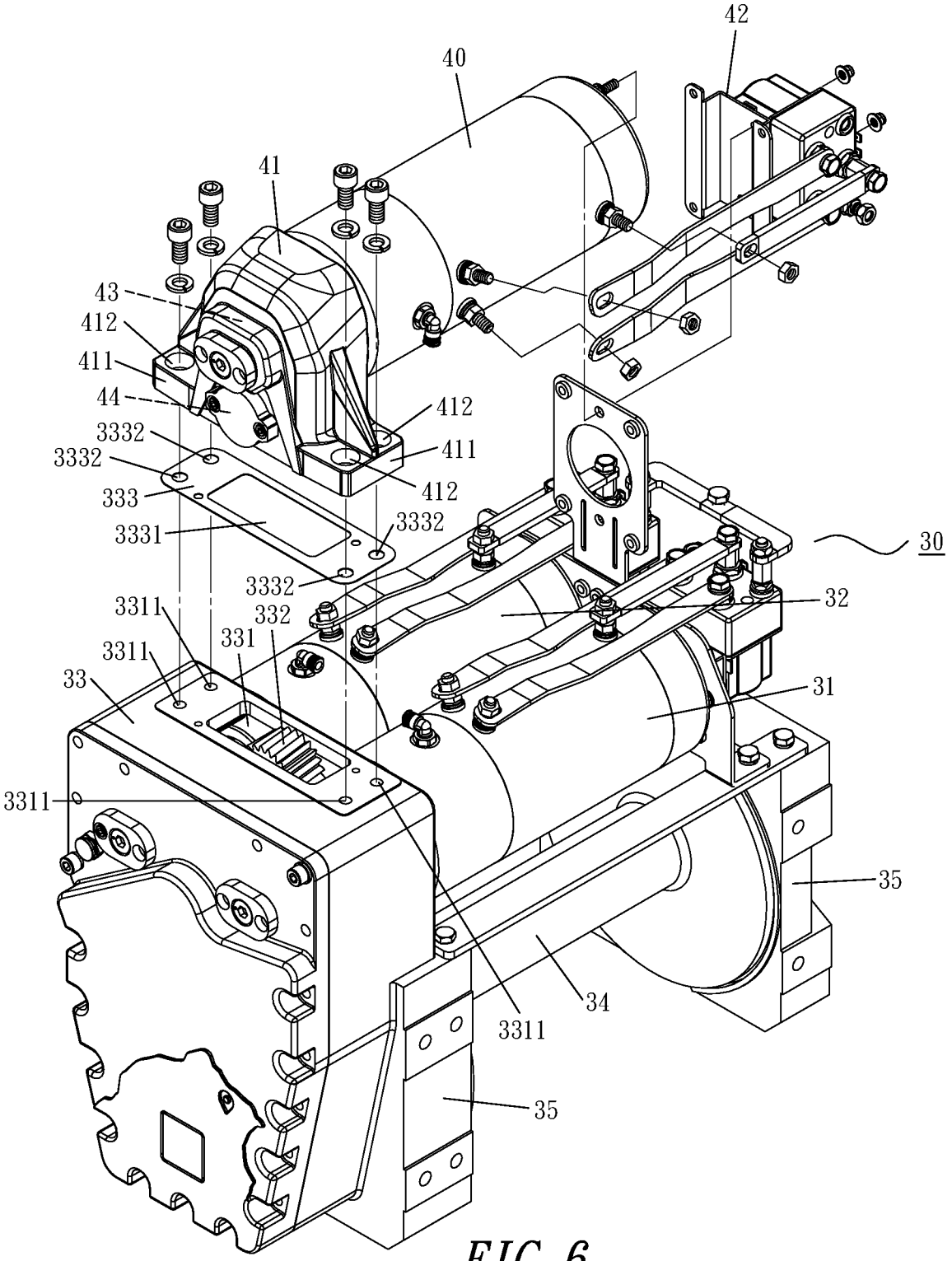
FIG. 6 is a partial exploded drawing for assembling externally connected motors to form the three-motor type winch according to the embodiment of the invention.
Figure 7:
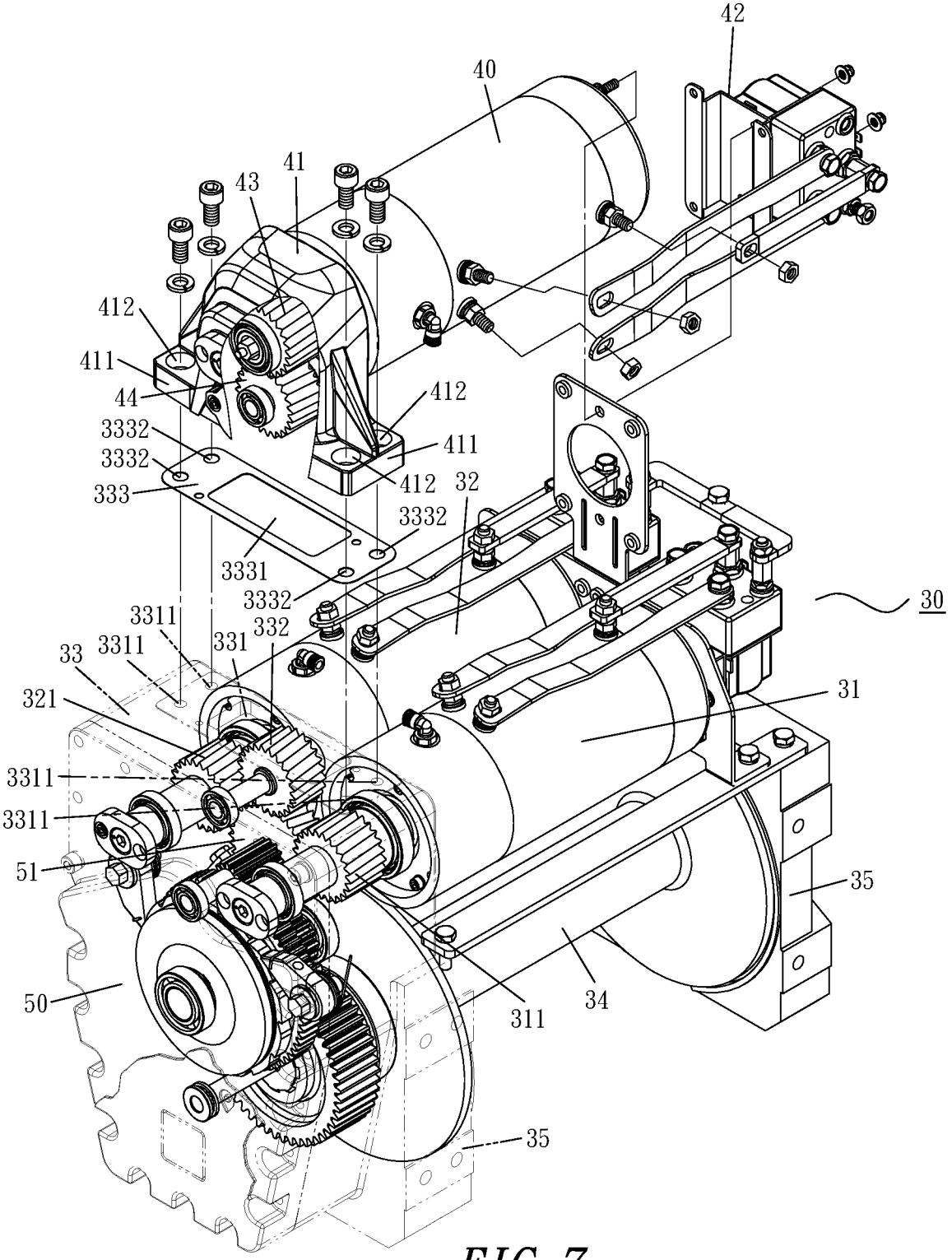
FIG. 7 is a partial exploded drawing II for assembling externally connected motors to form the three-motor type winch according to the embodiment of the invention.
Figure 8:
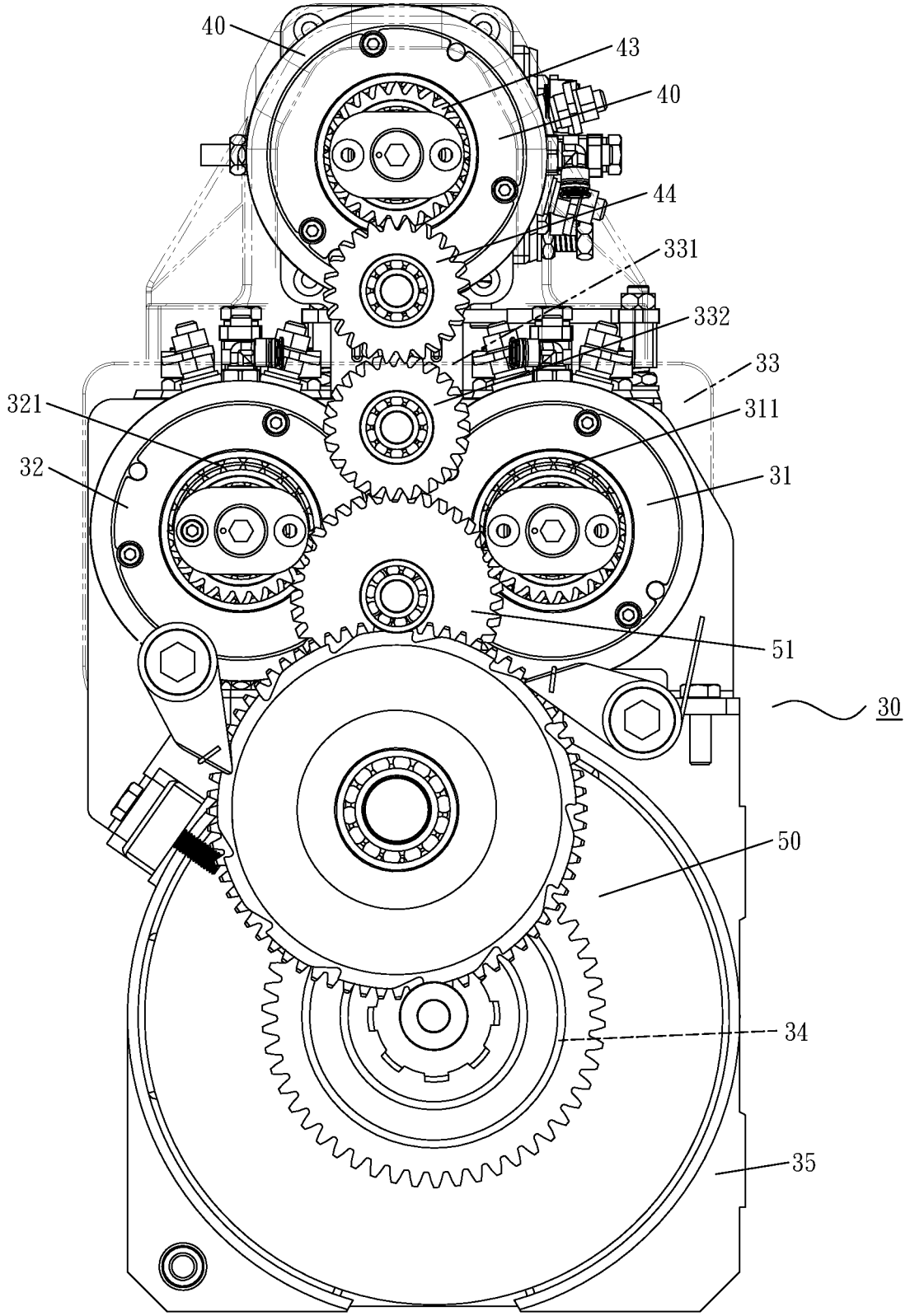
FIG. 8 is a left side view for assembling externally connected motors to form the three-motor type winch according to the embodiment of the invention.

A composition relation between the externally connected motor 40 and the driving device box 33 is shown in FIGS. 6 to 8. A front end of an output shaft of the externally connected motor 40 is disposed with an output gear 43 inside the front housing 41. An intermediate gear 44 is meshed below the output gear 43. The output gear 43 and the intermediate gear 44 are disposed inside the front housing 41. A lower portion of the front housing 41 is opened so that the intermediate gear 44 appears a bottom surface of the front housing 41. A front and rear sides at a bottom portion of the front housing 41 are outwardly and respectively extended to form a joining wall body 411. Joining perforations 412 are opened on the joining wall body 411. A top surface of the driving device box 33 is opened with an opening hole 331. A driving gear 332 for meshing is disposed inside the opening hole 331. A front and rear ends of a spindle of the driving gear 332 are disposed between two side wall bodies of the driving device box 33 through support of the bearing so that few portions of tooth bodies of the driving gear 332 upwardly penetrate through the opening hole 331. A front and rear side wall bodies of the top surface of the opening hole 331 are opened with joining screw holes 3311 correspondingly matching the joining perforations 412. A top surface of the opening hole 331 can be pasted with a sealing sheet 333. The sealing sheet 333 has a piercing hole 3331 corresponding to the opening hole 331 and a joining pierced hole 3332 corresponding to the joining screw hole 3311.

While in assembling, the sealing sheet 333 is firstly pasted to the opening hole 331 on the top surface of the driving device box 33 to allow the piercing hole 3331 of the sealing sheet 33 aligning the opening hole 331, and the joining pierced hole 3332 of the sealing sheet 333 aligns the joining screw hole 3311 one by one. Afterward the joining wall body 411 of the front housing 41 of the externally connected motor 40 is attached to the top surfaces of the sealing sheet 333 and the driving device box 33 so that the joining perforation 412 of the front housing 41 aligns the joining pierced hole 3332 of the sealing sheet 333 and the joining screw hole 3311 of the driving device box 33 one by one. In the process, the intermediate gear 44 inside the front housing 41 meshes the driving gear 442, and screw bolt is tightly locked with the joining screw hole 3311 after penetrating through the joining perforation 412 and the joining pierced hole 3332. Accordingly, assembling relation of the front end of the externally connected motor 40 fixedly connected to the top surface of the driving device box 33 can be achieved through the front housing 41.

With reference to FIGS. 6 to 8, according to the foregoing illustration, the set of motors 31, 32 belonging to stationary type is assembled to a side outside the driving device box 33. Afterward front ends of the output shafts of the motors 31, 32 stretch into the driving device box 33 and are disposed with output gears 311, 321. In configuration, the output gears 311, 321 and the driving gear 332 are meshed with an initial gear 51 (as shown in FIGS. 7, 8). Therefore, outputs of the motors 31, 32 would be transmitted to the initial gear 51 by respectively passing through the output gears 311, 321. At the same time, the output of the externally connected motor 40 would be transmitted to the initial gear 51 through gearing of the output gear 43 and the intermediate gear 44.

The initial gear 51 belongs to a forefront gear (as shown in FIGS. 7, 8) of a driving device 50. The driving device 50 is disposed inside the driving device box 33. After driving at all levels, the rope wheel 34, in which the location is disposed below the set of motors 31, 32, is driven so that the rope (the steel cable or the synthetic rope) winding the rope wheel 34 can be controlled by power to perform motion of releasing or retracting the rope (the steel cable or the synthetic rope) on demand. The driving device 50 is not illustrated herein regarding its structure composition and effect since it is not the improved emphasis of the disclosure.

The externally connected motor 40 is a "third motor" capable of being selectively assembled or selectively disassembled. A motion of selectively assembling the externally connected motor 40 is shown in FIGS. 6-8 and the foregoing detail. If the externally connected motor 40 is required to be disassembled from assembled state, screw bolt tightly locked in the joining perforation 412, the joining pierced hole 3332 and the joining screw hole 3311 is withdrawn, and at the same time, the rear support rack 42 connected at the rear end of the externally connected motor 40 is released from the support seat 35 so that the externally connected motor 40 is upwardly pulled and removed from the winch 30 together with the front housing 41 at the front end and the rear support rack 42 at the rear end. In the process, the intermediate gear 44 within the front housing 41, from original meshing state, is instantly detached from the driving gear 332. Therefore, the externally connected motor 40 (together with the front housing 41 at the front end and the rear support rack 42 at the rear end) can be entirely and easily withdrawn from the winch 30.

Figure 9:
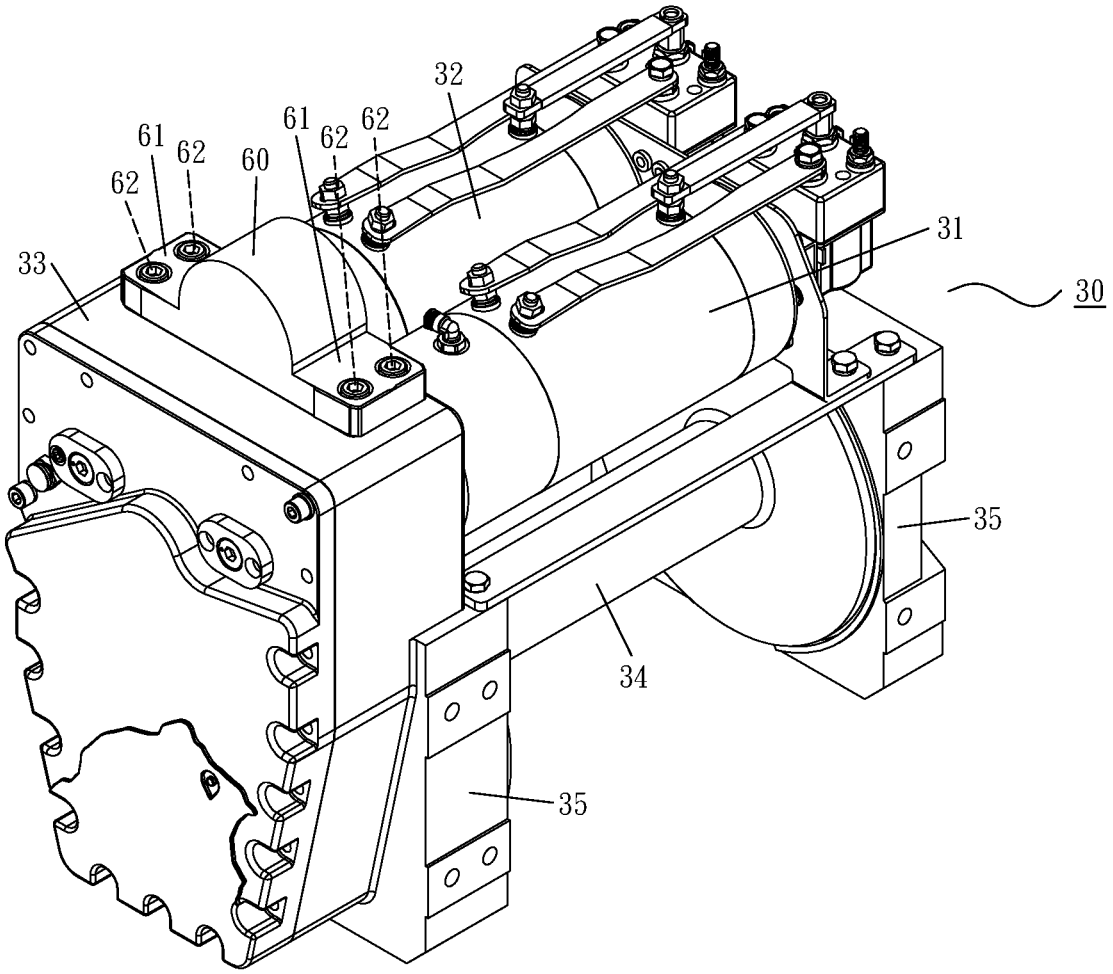
FIG. 9 is a three-dimensional drawing for disassembling externally connected motors to form a dual-motor type winch according to the embodiment of the invention.
Figure 10:
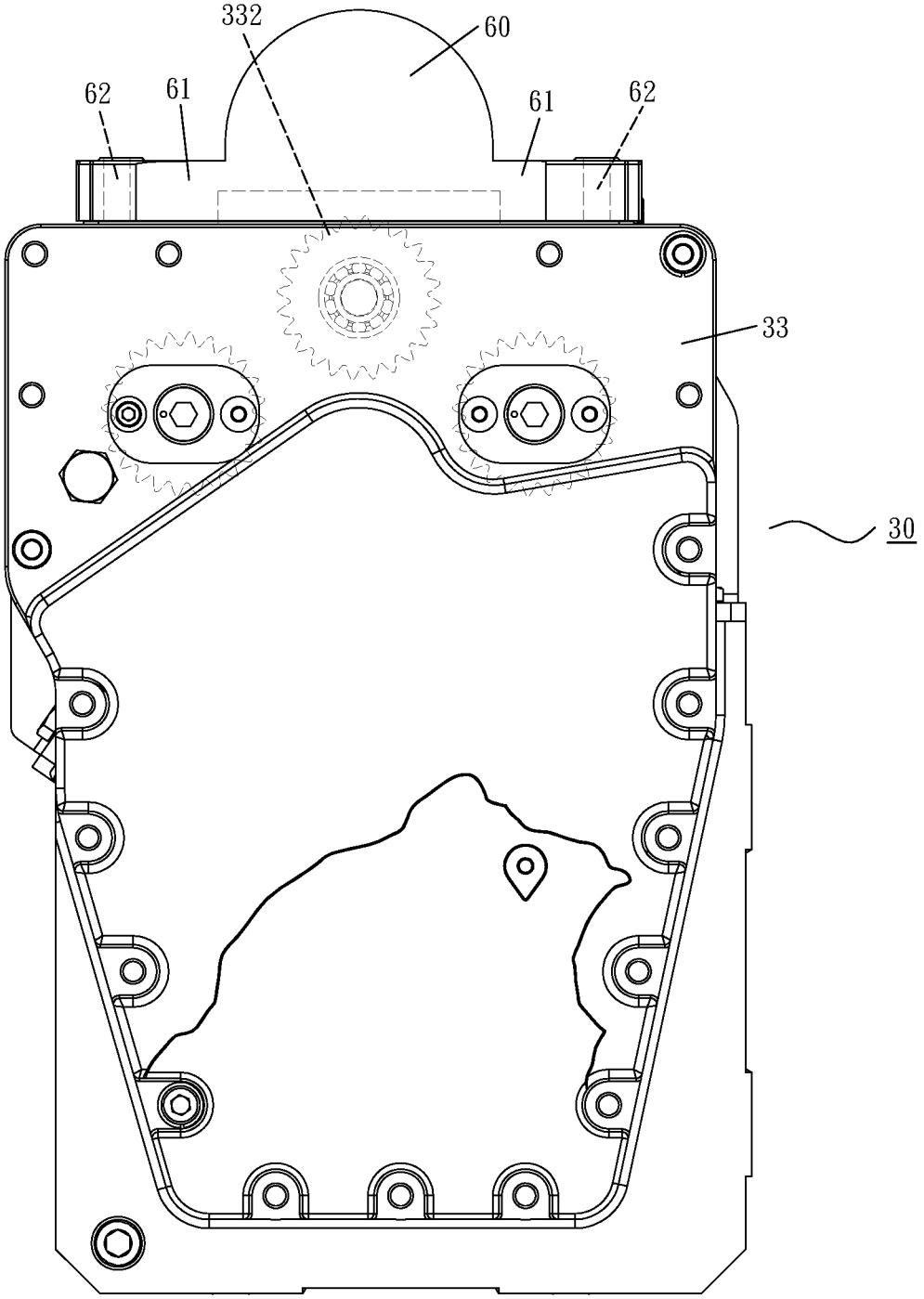
FIG. 10 is a side view for disassembling externally connected motors to form a dual-motor type winch according to the embodiment of the invention.

After the externally connected motor 40 (together with the front housing 41 at the front end and the rear support rack 42 at the rear end) is taken away from the winch 30, a decorative cover 60 covers the opening hole 331 to shield the opening hole 331 and the driving gear 332 because few portion of tooth bodies of the driving gear 332 upwardly penetrating out of the opening hole 331. As shown in FIGS. 9, 10, a main body of the decorative cover 60 can be made as higher state. Its appearance can be printed with commercial activities, and a front and rear sides at the bottom end of the main body are outwardly extended to form a joining wall body 51, respectively. The joining wall body 61 is opened with a joining through hole 62. When the decorative cover 60 covers the opening hole 331, the joining wall body 61 of the decorative cover 60 pastes the sealing sheet 333 (because the sealing sheet 333 does not come off together with the front housing 41). Afterward the screw bolt is tightly locked with the joining screw hole 3311 after passing through the joining through hole 62 and the joining pierced hole 3332, thereby achieving assembled relation and effect of shielding the opening hole 331 through the decorative cover 60 and having advertisement efficacy at the same time.

Accordingly, with respect to factories, the completed winch 30 having three motors 31, 32, 40 is completely assembled. After a user (a player for all terrain vehicle, jeep or recreational vehicle) bought the completed winch 30 to be assembled on the vehicle, usage state for existence of three motors 31, 32, 40 can be selected. The maximum torque can be supplied to the driving gear 50 to provide the maximum pulling force and the fastest pulling rate to the rope wheel 34, thereby applying in greater load and more dangerous environment. When the user evaluates the maximum torque is not required, the externally connected motor 40 can be selected to be disassembled so as to save more power and energy resource during usage.

With the foregoing depiction, the disclosure is that a winch driven by a set of motors can be further selectively assembled and increased with an externally connected motor (a third motor) so that the driving device disposed inside the driving device box takes power supplied by three motor at the same time to provide greater pulling force and faster pulling rate for the rope wheel of the winch so as to provide wider application range. Simultaneously, the externally connected motor (the third motor) can be disassembled when there is no need such that merely two motors are allowed to provide dynamic power, thereby saving power and energy resource.

While pneumatic and manual clutch device of the power winch disclosed by the present invention has been described by means of specific embodiments, numerous modifications and variations could be made thereto by those skilled in the art without departing from the scope and spirit of the invention set forth in the claims.

What is claimed is:

1. A winch capable of externally connecting motors to increase dynamic power, the winch having a set of motors, front ends of output shafts of the set of motors respectively connected with an output gear and stretching into a driving device box disposed at a side to mesh an initial gear of a driving device to further drive a rope wheel, disposed below the set of motors, for rotating so that a rope winding the rope wheel performs motion of releasing or retracting the rope through power control, the rope wheel supported by a support seat; the characterized in that: an externally connected motor further assembled above the set of motors, a front end of the externally connected motor fixedly connected on a top surface of the driving device box through support of a front housing while a rear end is fixedly connected above the support seat through support of a rear support rack, a front end of the output shaft of the externally connected motor disposed with an output gear inside the front housing, an intermediate gear meshed below the output gear, the output gear and the intermediate gear disposed inside the front housing, lower portion of the front housing opened; a top surface of the driving device box opened with an opening hole, a driving gear disposed inside the opening hole, a portion of tooth bodies of the driving gear upwardly penetrating through the opening hole, the intermediate gear inside the front housing meshing the driving gear, the driving gear meshing the initial gear of the driving device.

2. The winch capable of externally connecting motors to increase dynamic power of claim 1, wherein a front and rear sides at a bottom of the front housing are respectively and outwardly extended to form a joining wall body, and the joining wall body is opened with a joining perforation; a front and rear side wall bodies of the opening hole opened with a joining screw hole correspondingly matching the joining perforation; a top surface of the opening hole pasted with a sealing sheet, the sealing sheet having a piercing hole corresponding to the opening hole and a joining pierced hole corresponding to the joining screw hole; when a front housing at a front end of the externally connected motor fixedly connected to the top surface of the driving device box, the joining wall body of the front housing pasted to the sealing sheet and the top surface of the driving device box so that the joining perforation of the front housing aligns the joining pierced hole of the sealing sheet and the joining screw hole of the driving device box, a screw bolt tightly locked with the joining screw hole of the driving device box after passing through the joining perforation of the front housing, the joining pierced hole of the sealing sheet.

3. The winch capable of externally connecting motors to increase dynamic power of claim 1, wherein a front and rear ends of a spindle of the driving gear are disposed between two side wall bodies of the driving device box through support of a bearing.

4. The winch capable of externally connecting motors to increase dynamic power of claim 1, wherein an opening hole on the top surface of the driving device box is covered by a decorative cover to shield the opening hole.

5. The winch capable of externally connecting motors to increase dynamic power of claim 4, wherein the decorative cover is respectively and outwardly extended to form a joining wall body at a front and rear sides at a bottom portion of the main body; and when the decorative cover covers the opening hole, the joining wall body of the decorative cover is pasted to the sealing sheet and a top surface of the driving device box so that a joining through hole of the decorative cover aligns the joining pierced hole of the sealing sheet and the joining screw hole of the driving device box, and a screw bolt is tightly locked with the joining screw hole of the driving device box after passing through the joining through hole of the decorative cover and the joining pierced hole of the sealing sheet.

* * * * *